US006237373B1

(12) United States Patent
Harris et al.

(10) Patent No.: US 6,237,373 B1
(45) Date of Patent: May 29, 2001

(54) LIQUIFIED GAS DRY-CLEANING VESSEL WITH SELF-CONTAINED FRONT ACCESS LINT PANEL

(76) Inventors: Stephen L. Harris, 365 Westbrook Dr., Oshkosh, WI (US) 54904; Andrew F. Kegler, 547 Eureka St., Ripon, WI (US) 54971; Gregory L. Malchow, 1903 Scarlet Oak Trail, Oshkosh, WI (US) 54904

( * ) Notice: Subject to any disclaimer, the term of this patent is extended or adjusted under 35 U.S.C. 154(b) by 0 days.

(21) Appl. No.: 09/338,653

(22) Filed: Jun. 23, 1999

(51) Int. Cl.[7] ..... D06F 43/02; D06F 39/10
(52) U.S. Cl. ..... 68/18 F
(58) Field of Search ..... 68/18 F

(56) References Cited

U.S. PATENT DOCUMENTS 3,531,954 * 10/1970 Krupsky ..... 68/18 F
3,568,477 * 3/1971 Dixon et al. ..... 68/18 F
4,580,421 * 4/1986 Babuin et al. ..... 68/18 F X
4,711,103 * 12/1987 Mori et al. ..... 68/18 F X
5,660,063 * 8/1997 Lee et al. ..... 68/18 F

* cited by examiner

*Primary Examiner*—Philip R. Coe
(74) *Attorney, Agent, or Firm*—Leydig, Voit & Mayer, Ltd.

(57) ABSTRACT

A liquified gas dry-cleaning system having a cleaning vessel, a rotary basket supported within the cleaning vessel for containing items during cleaning, and a door movable between a closed position sealing the cleaning vessel and an open position for permitting access to the rotary basket and items contained therein. A lint filter is mounted within the cleaning vessel for removing lint and other course particulate matter from the liquified gas wash bath as it is drained from the cleaning vessel following a dry-cleaning cycle. The lint filter has a filter surface which is disposed under a front entry opening of the basket for easy access and manual cleaning each time the cleaning vessel door is opened and items are removed from the basket following a cleaning cycle.

20 Claims, 5 Drawing Sheets

LIQUIFIED GAS DRY-CLEANING VESSEL WITH SELF-CONTAINED FRONT ACCESS LINT PANEL

FIELD OF THE INVENTION

The present invention relates generally to dry-cleaning systems and, more particularly, to a liquified gas dry-cleaning pressure vessel with a self-contained and more accessible lint filter.

BACKGROUND OF THE INVENTION

Known dry-cleaning processes consist of a wash, rinse, and draining/drying cycle with solvent recovery. During the dry-cleaning process, items, such as garments, are loaded into a basket disposed within a vessel and immersed in a dry-cleaning solvent that is pumped into the vessel from a base tank. Conventional dry-cleaning solvents include perchloroethylene (PCE), petroleum-based or Stoddard solvents, CFC-113, and 1,1,1-trichloroethane, all of which are generally aided by a detergent.

The use of these conventional solvents, however, poses a number of health and safety risks as well as being environmentally hazardous. For example, halogenated solvents are known to be environmentally unfriendly, and at least one of these solvents, PCE, is a suspected carcinogen. Known petroleum-based solvents are flammable and can contribute to the production of smog. Accordingly, dry-cleaning systems which utilize dense phase fluids, such as liquid carbon dioxide, as a cleaning medium have been developed. An apparatus and method for employing liquid carbon dioxide as the dry-cleaning solvent is disclosed in U.S. Pat. No. 5,467,492, entitled "Dry-Cleaning Garments Using Liquid Carbon Dioxide Under Agitation As Cleaning Medium". A similar dry-cleaning apparatus is also disclosed in U.S. Pat. Nos. 5,651,276.

These liquified gas dry-cleaning systems pose a number of other problems, particularly in relation to the high operating pressures necessary for maintaining the gas in a liquid state. Specifically, the cleaning vessel in a liquid carbon dioxide system operates at between 700–850 psi under ambient temperature conditions. In addition to the cleaning vessel, the dry-cleaning apparatus has other vessels or chambers associated with the regular operation and maintenance of the system which are regularly exposed to elevated pressures.

Following each wash cycle, for example, a wash bath liquid is cycled through a lint filter which separates lint and other coarse particulate matter from the wash bath. Because of the high operating pressures, the lint filter must have a relatively bulky, heavy-walled construction, which is costly and requires dedicated piping and high pressure seals. Moreover, since the lint filter must be accessed on a regular basis for routine cleaning and maintenance, sometimes as frequent as after the completion of each laundry load, it is desirable that the lint filter be readily accessible to an operator. However, because of the bulky construction, the access doors to such pressurized lint filter vessels can be cumbersome to open and handle. These difficulties can make it inconvenient for an operator to open the lint filter, and can discourage the operator from checking and cleaning the lint filter as frequently as is needed to ensure optimal operation of the dry-cleaning system. Since such lint filters typically have relatively small filter surface areas through which the wash bath is directed, even minor neglect in cleaning of the filter of course particulate matter can seriously impede operation of the dry-cleaning system.

OBJECTS AND SUMMARY OF THE INVENTION

It is an object of the present invention to provide a liquified gas dry-cleaning system with a more economical and accessible lint or course filter.

Another object is to provide a liquified gas dry-cleaning system with a lint filter that requires no additional pressure vessels, piping, or costly sealing.

A further object is to provide a liquified gas dry-cleaning system with an easily accessible lint filter that encourages regular cleaning after the completion of each dry-cleaning load.

Still another object is to provide a liquified gas dry-cleaning system having a lint filter that can be easily cleaned without removal of special filter doors or covers.

Other objects and advantages of the invention will become apparent upon reading the following detailed description and upon reference to the drawings, in which:

Figure 1:
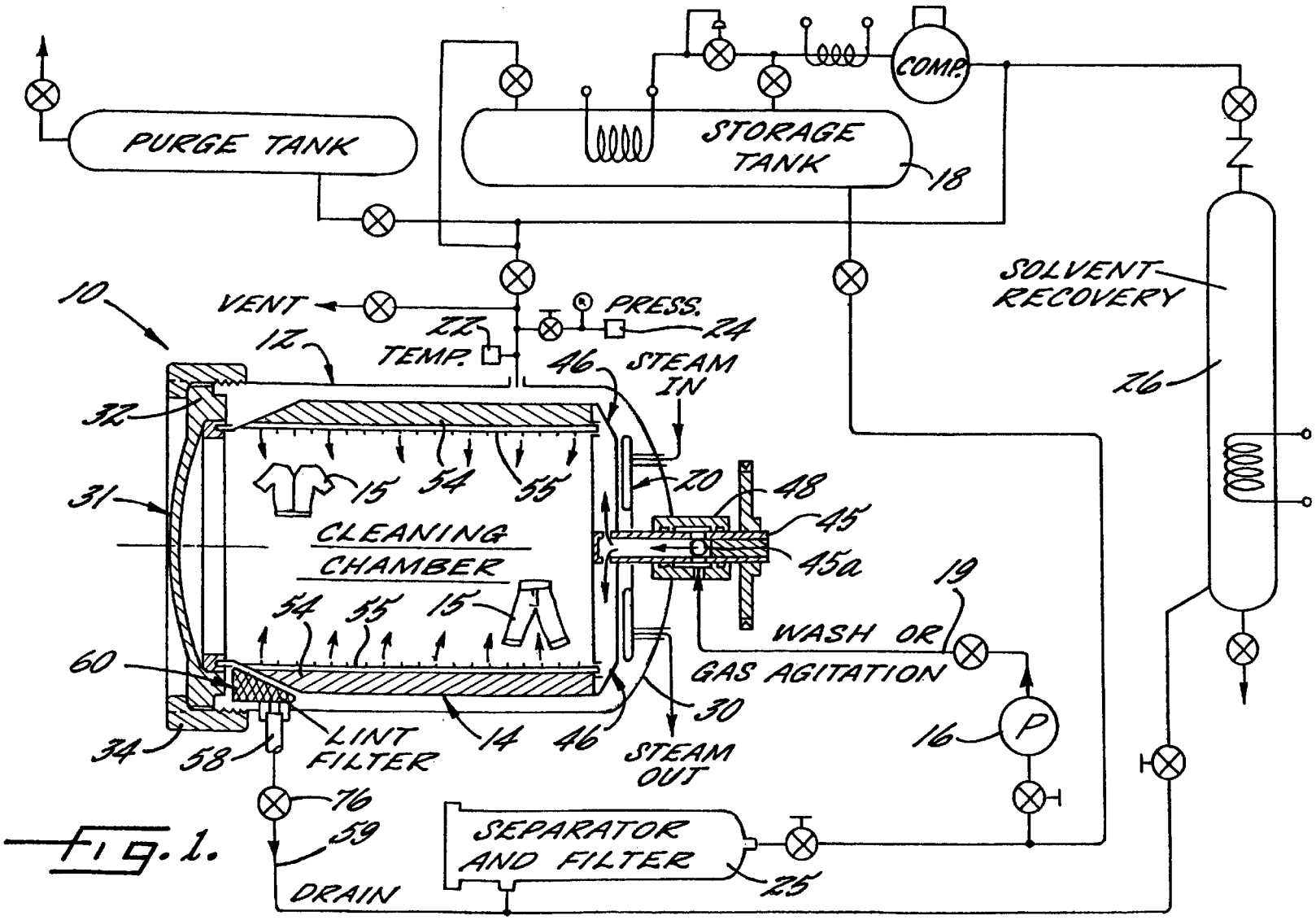
FIG. 1 is a schematic of a liquified gas dry-cleaning system in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE DRAWINGS

Referring now more particularly to FIG. 1 of the drawings, there is shown a diagrammatic depiction of an illustrative liquified gas, dry-cleaning machine 10 embodying the present invention. In general, the dry-cleaning machine 10 includes a cleaning vessel 12 having a basket 14 rotatably disposed therein for containing items 15 to be cleaned. A liquid wash bath derived from a liquifiable gas, such as carbon dioxide, is used as the dry-cleaning solvent. A pump 16 is provided for directing the wash bath from a gas supply storage tank 18 and through an inlet line 19 into the pressure vessel 12. The vessel 12 is equipped with a steam heater 20, pressure sensor 21, and temperature sensor 22 to aid in temperature and pressure control for properly maintaining the wash bath in liquid phase during the dry-cleaning cycle.

The basic operation of a liquid gas dry-cleaning system is known in the art, as reflected by U.S. Pat. Nos. 5,651,276, 5,467,492, and 5,651,276, the disclosures of which are incorporated herein by reference. After the basket 14 is loaded with items, such as garments, for cleaning, the pump 16 charges the vessel 12 with a wash bath drawn from the storage tank 18, which functions as the cleaning solvent during a drying cycle. Upon completion of the dry cleaning cycle, the wash bath is drained from the cleaning vessel and remaining wash bath vapors evacuated and re-liquified by an appropriate condenser for return to the storage tank.

For separating contaminants from the wash bath liquid following a cleaning cycle, the wash bath is cycled through a filtration and separator system 25 which functions to filter and vaporize the wash bath, thereby concentrating the particulate matter and other contaminants. The gaseous vapor is re-liquified in a condenser 26 for return to the storage tank 18.

Figure 2:
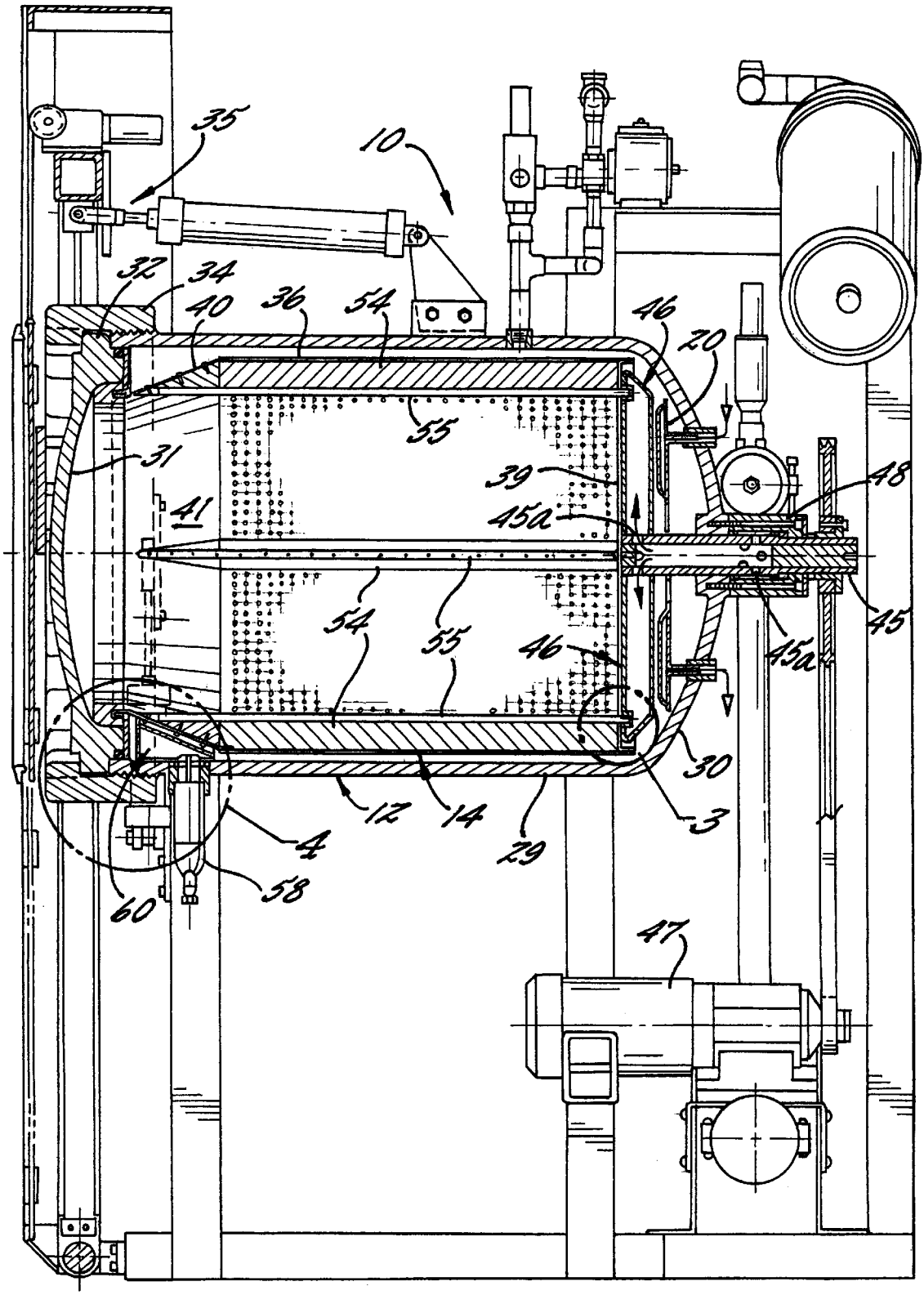
FIG. 2 is an enlarged vertical section of the liquified gas dry-cleaning machine depicted in FIG. 1.
Figure 4:
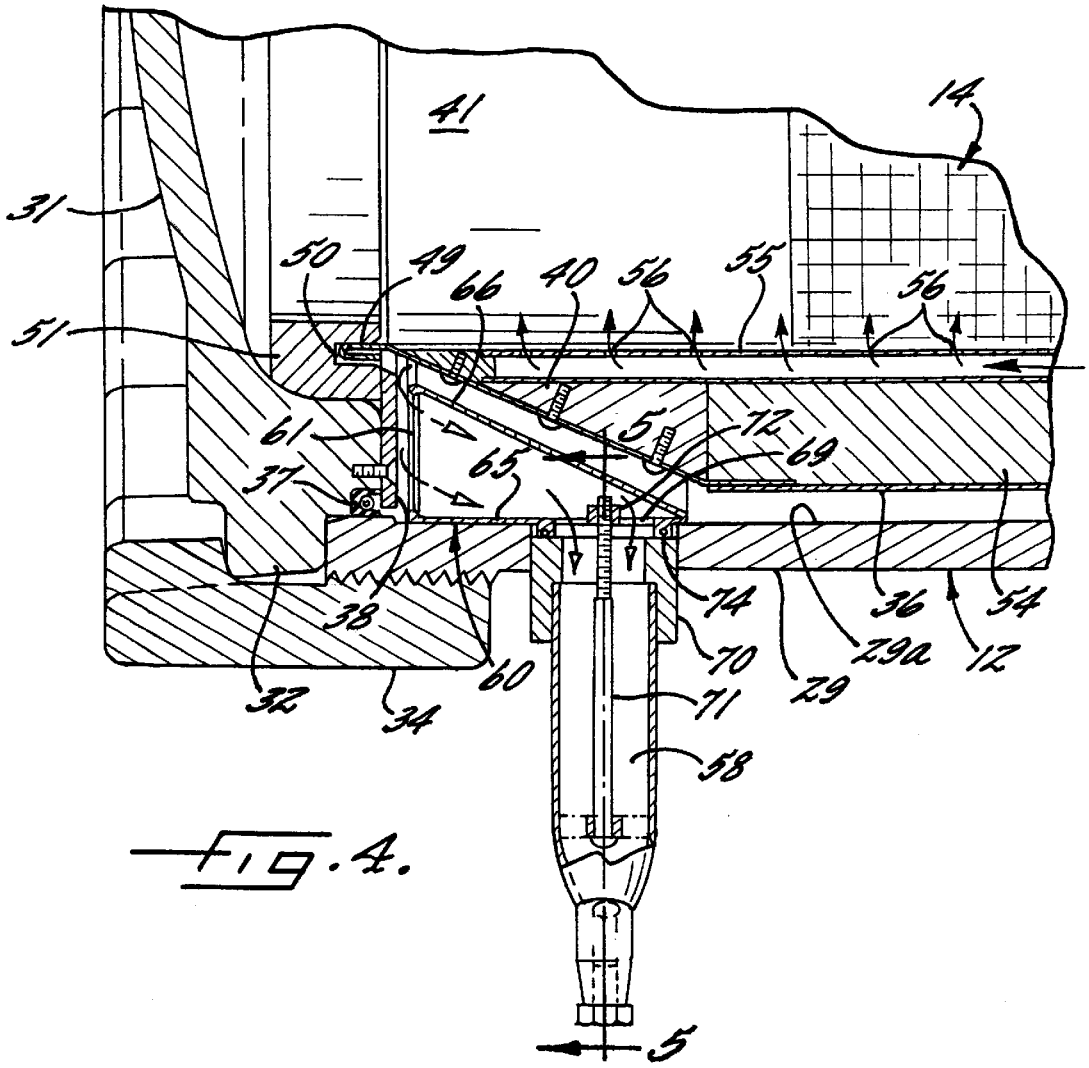
Figure 5:
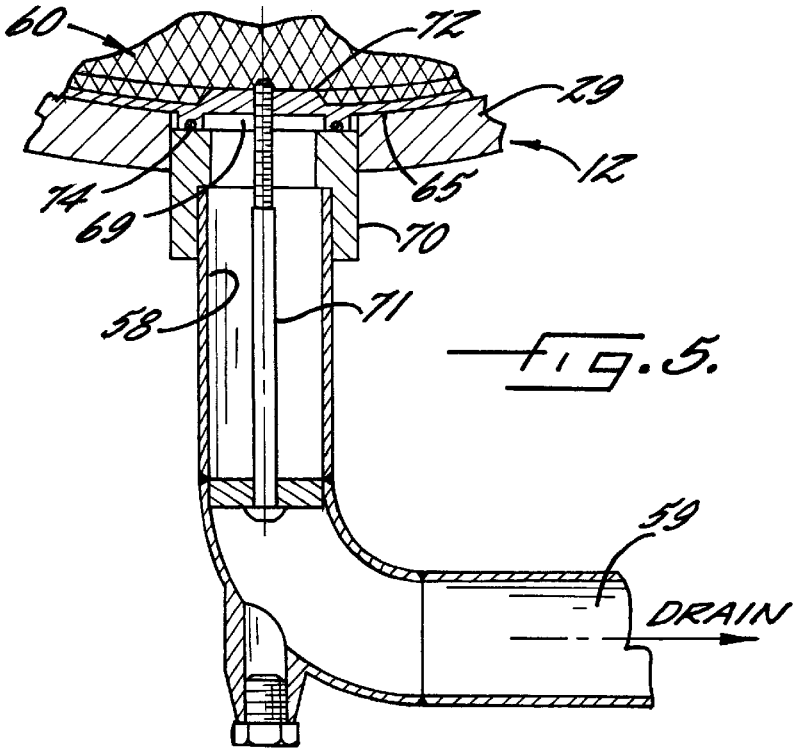
FIG. 5 is an enlarged vertical section of the pressure vessel drain of the illustrated apparatus, taken in the plane of lines 5—5 in FIG. 4.

The illustrated cleaning vessel 12, as best depicted in FIG. 2, comprises an elongated housing 29 having a rounded end wall 30 integrally formed at one end and a removable door 31, also of generally rounded configuration, releasably secured at the other end. The housing 29 defines a cylindrical cleaning chamber within which the rotary basket 14 is disposed. The removable door 31 has an outer annular retaining flange 32 secured in abutting relation to the end of the housing 29 by means of a locking ring 34 threadedly engaging the end of the housing 29. An annular seal 37 is retained about the door by a retainer plate 38 which is screwed to the door and defines an innermost annular face of the door when in a closed position (FIG. 4). For removing the door 30 to permit loading and unloading of items into the cleaning vessel 12, an apparatus 35 may be provided for rotating the locking ring 34 to an unlocked position, and automatically removing and lowering the door 31, as disclosed in commonly assigned application Ser. No. 09/338,590 filed Jun. 23, 1999, the disclosure of which is incorporated herein by reference.

Figure 3:
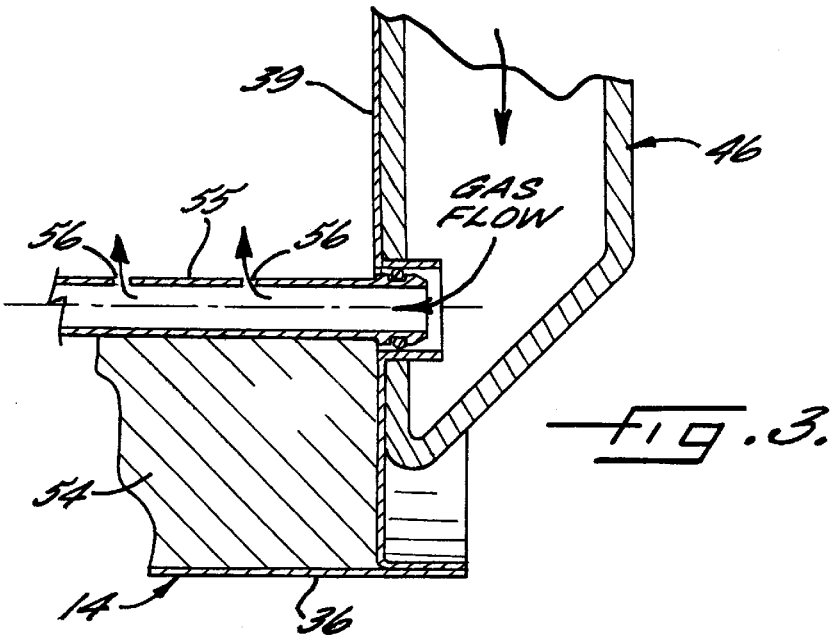
FIGS. 3 and 4 are enlarged vertical sections depicting the encircled areas referenced 3 and 4, respectively, in FIG. 2.
Figure 6:
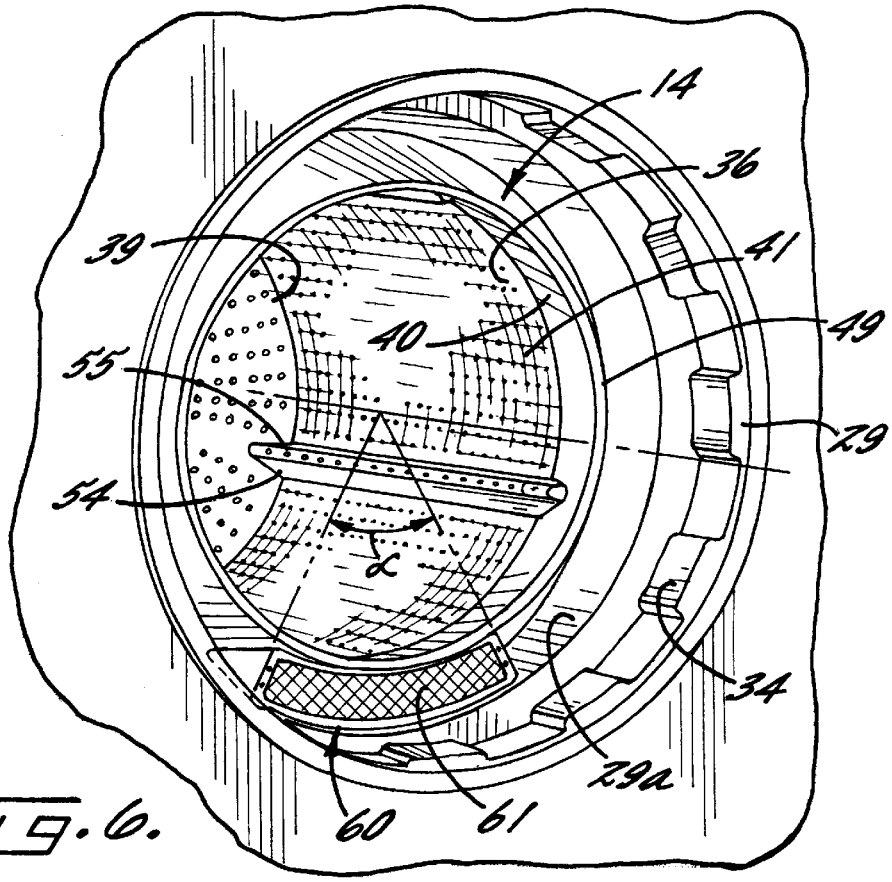
FIG. 6 is a perspective of the pressure vessel and rotary basket disposed therein, taken from the front of the dry-cleaning machine with the pressure vessel door in an open position.
Figure 7:
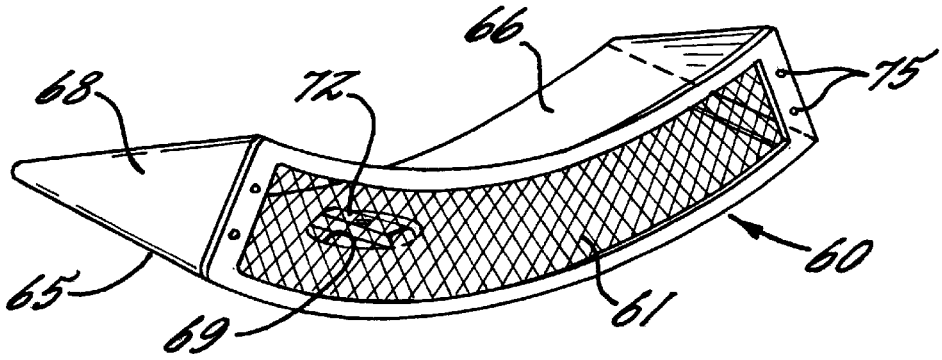
FIGS. 7 and 8 are perspectives of the lint or course filter for the illustrated machine.
Figure 8:
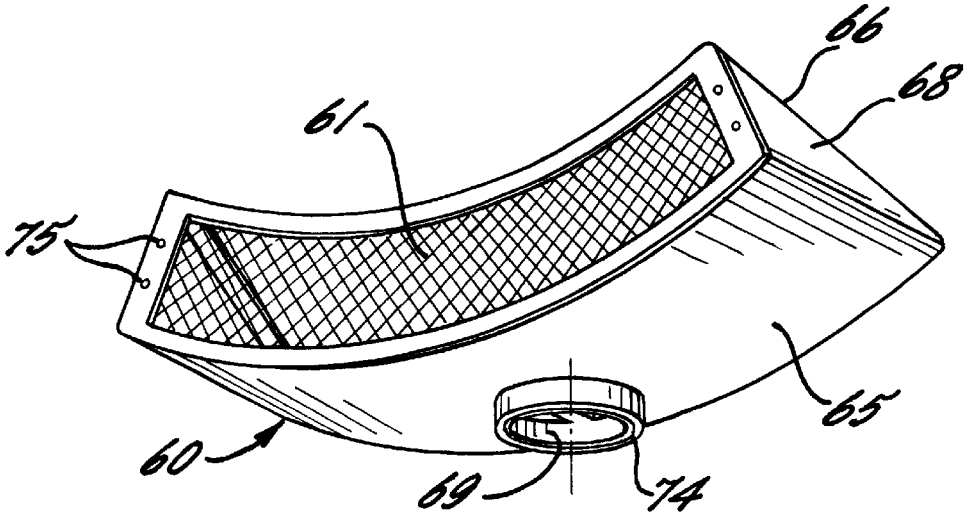

The basket 14 for receiving and containing items to be cleaned is substantially coextensive in length with the housing 29 and has an outer cylindrical perforated sleeve 36 for enabling circulation of the liquid wash bath through the basket 14 during wash and rinse cycles. The perforated sleeve 36 is secured between a perforated back plate 39 and a front member 40 that defines a central inlet opening 41 to the basket 14 when the door 31 is opened (FIGS. 3, 4, 6).

For supporting the basket 14 for rotating movement relative to the cleaning vessel 12, the basket 14 has an outwardly extending support and drive shaft 45 extending through the pressure vessel end wall 30 and a spider-configured trunion 46 fixed to the shaft 45 and back plate 39. The drive shaft 45, which preferably is reversibly driven by a bi-directional motor 47, is rotatably supported in an annular collar or bushing 48 affixed in outstanding relation to the end wall 30 of the cleaning vessel. For supporting the opposite end of the basket 14 for rotational movement when the door 31 is in a closed position, the front member 40 terminates in an annular ring 49 that is received and supported within a groove 50 of an annular pilot plate 51 fixed within an annular recess of door 31 on the inner side thereof (FIG. 4).

For agitating items contained within the basket and wash bath and for enhancing removal of solid particulate material from the items during a dry cleaning cycle, the basket 14 has a plurality of longitudinal mixing baffles 54, oriented parallel to the rotary axis of the basket, which each support a gas jet manifold 55 formed with a plurality of axially spaced, discharge orifices or nozzles 56, as disclosed in commonly assigned application Ser. No. 09/338,292, filed Jun. 23, 1999, disclosure of which also is incorporated herein by reference. Liquified gas is directed from the storage tank 18 through the bushing 48 and communicates through radial apertures 49 in the drive shaft with a shaft passage 56, hollow legs of the trunion 46 and through the manifold tubes 55 for radial direction as pressurized jets or streams of liquified gas into the basket 14 simultaneously with rotation of the basket 14 and mechanical agitation of the items and wash bath by the baffles 54.

Following the dry-cleaning cycle, the liquid wash bath is drained from the cleaning vessel 14 through a drain 58 mounted in the bottom of the pressure vessel housing 29 and directed to the filtration and separator system 25 via a return line 59. As indicated above, before entering the filtration and separator system 25, it is desirable that the wash bath be directed through a lint filter for removing lint and other course particulate material dislodged from items dry-cleaned. Typically, such lint filters are disposed in the return line 59 upstream of the filtration and separator system 25 and comprise a filter screen or the like disposed within a pressurized vessel having a removable access door for permitting cleaning of the filter screen. Such lint filters are relatively costly, cumbersome to open, and have filter screens sized such that if the filter is not regularly cleaned, the dry-cleaning operation can be seriously impeded.

In accordance with the invention, the liquified dry-cleaning system has a lint or course filter that is readily accessible for cleaning upon the completion of each dry-cleaning operation, without the necessity for opening special doors, covers, or the like. More particularly, the lint filter is contained within the cleaning vessel of the liquified gas dry-cleaning machine and has a front filter surface that is immediately accessible for cleaning by an operator each time the cleaning vessel door is opened following completion of a dry-cleaning load. To this end, in the illustrated embodiment, the cleaning vessel 12 has a lint filter 60 disposed directly below the entry opening 41 of the basket 14 with a front or forwardly facing filter surface 61 defined by a conventional screen or grid adapted for filtering lint and other course solid and particulate matter from the wash bath following a dry-cleaning operation. For purposes herein, the term "lint filter" is intended to mean a filter operable for filtering lint and other course solid particulate matter.

For providing space for the lint filter 60 in the front of the cleaning vessel housing 29, the front member 40 of the basket 14 in this case has a forwardly and inwardly converging conical shape. The lint filter 60 has a segmented cylindrical shape which conforms to the space between the conical front basket member 40 and an inner cylindrical wall **29*a* of the cleaning vessel housing 29 (FIGS. 4 and 6). The lint filter 60 in this case has a edge-shaped housing defined by a cylindrical bottom wall 65 mounted on the inner cylindrical wall 29*a* of the cleaning vessel housing, a conical upper wall 66 shaped similarly to the conical front basket member 40 and extending rearwardly and outwardly to a rear peripheral edge of the filter housing bottom wall 65, and triangular-shaped side or end walls 68 that enclose opposite ends of the lint filter housing. The bottom wall 65 has a discharge opening 69 communicating with the drain 58, which in this case is fixed to a mounting sleeve 70 of the cleaning vessel housing 29 by a retaining bolt 71 secured to a spider configured retainer 72 disposed within the filter housing discharge opening 69. An O-ring seal 74 is provided between the filter housing bottom wall 65 and the cleaning vessel drain mounting sleeve 70**.

The lint filter screen 61 is secured to the front of the lint filled housing by screws 75 so as to be in outwardly facing relation to the pressure vessel housing in a plane perpendicular to the axis of the cylindrical basket 14, as depicted in FIG. 6. The lint filter 60 is mounted in the front of the cleaning vessel housing 29 with the upper housing wall 66 in spaced relation to the conical front basket member 40 and with the filter surface 61 disposed in spaced relation to the inner face of the cleaning vessel door 31 defined by the retaining plate 38 so as to enable circulation of the wash bath about the lint filter housing and the free flow of wash bath through the lint filter screen 61 and to the drain 58 upon opening of a discharge valve 76 (FIG. 1).

It can be seen that since the filter screen 61 extends circumferentially about the lower perimeter of the pressure vessel housing 14, it provides an expanded surface area through which the wash bath may be passed upon direction to the drain. The filter screen 61 in this case extends circumferentially about the cleaning vessel housing, corresponding to an angle a of about 60 degrees. It will understood that to increase the surface area, the filter screen 61 could extend circumferentially a greater distance, up to an angle $\alpha$ of 180 degrees.

It will be understood by one skilled in the art that following completion of a dry-cleaning operation, the cleaning vessel door 31 will be unlocked and removed to permit removal of the dry-cleaned load. Since the filter screen 61 is adjacent the entry opening 41 to the garment-containing basket 14, it is a simple matter for the operator at the same time to clean lint and solid particulate matter that has accumulated in the lint filter screen 60 during the course of that cleaning cycle. The convenient and accessible location of the filter thereby encourages routing maintenance and cleaning of the filter each time the cleaning vessel is unloaded. Moreover, since the lint filter 60 is contained within the cleaning vessel 12, no additional pressure vessels, piping, or costly sealing is required for the lint filter. Nor is it necessary to remove cumbersome filter doors or covers, as heretofore been the practice.

What is claimed is:

1. A liquified gas dry-cleaning system comprising:

a cleaning vessel having a chamber for containing a wash bath of liquified gas under pressure; a basket supported within said chamber for containing items during cleaning, said basket having a front entry opening for enabling items to be introduced and removed from said basket, said cleaning vessel having door that is movable between an open position for enabling items to be loaded into said basket and a closed position sealing said cleaning vessel chamber, a liquid gas supply operable for selectively directing liquified gas to said cleaning vessel chamber when said door is closed for use during a cleaning operation cycle, said cleaning vessel having a drain for draining the wash bath from the cleaning vessel following a cleaning operation, a lint filter mounted within said cleaning vessel and having a filter surface through which said wash bath passes as it is directed to said drain, and said filter surface being disposed under said basket entry opening and being accessible for manual cleaning upon movement of said door to said open position.

2. The liquified gas dry-cleaning system of claim 1 in which said cleaning vessel chamber is cylindrical and said filter surface is in a plane perpendicular to a central axis of said cylindrical cleaning vessel chamber.

3. The liquified gas dry-cleaning system of claim 2 in which filter surface has a segmented cylindrical shape.

4. The liquified gas dry-cleaning system of claim 1 in which said lint filter includes a housing mounted on a bottom of said cleaning vessel chamber, and said filter surface is located on a front side of said housing facing said door when in a said closed position.

5. The liquified gas dry-cleaning system of claim 4 in which said lint filter housing has a discharge opening communicating with said drain.

6. The liquified gas dry-cleaning system of claim 4 in which said lint filter housing has upper and lower walls curved to conform with the shape of adjacent walls of said basket and cleaning vessel chamber, respectively.

7. The liquified gas dry-cleaning system of claim 1 in which said filter screen extends circumferentially about the front entry opening of said basket.

8. The liquified gas dry-cleaning system of claim 7 in which said filter surface extends a circumferential distance about the entry opening of said basket corresponding to an arc of about 60 degrees.

9. A liquified gas dry-cleaning system comprising:

a cleaning vessel having a chamber for containing a wash bath of liquified gas under pressure; a basket supported within said chamber for containing items during cleaning, said cleaning vessel having an access opening closeable by a door that is movable between an open position for enabling items to be loaded into said basket and a closed position sealing said cleaning vessel chamber, a liquid gas supply operable for selectively directing liquified gas to said cleaning chamber when said door is in a closed position for use during a cleaning operation, said cleaning vessel having a drain for draining the wash bath from the cleaning vessel following a cleaning operation, a lint filter mounted within said pressure vessel and having a filter surface through which said wash bath passes as it is directed to said drain, and said filter surface being disposed adjacent said cleaning vessel access opening and being accessible for manual cleaning upon movement of said door to said open position.

10. The liquified gas dry-cleaning system of claim 9 in which said basket has a front entry opening, and said lint filter is disposed below said basket entry opening.

11. The liquified gas dry-cleaning system of claim 10 in which said basket includes a cylindrical perforated section through which said wash bath circulates during a cleaning operation, and said basket entry opening is smaller in diameter than said perforated cylindrical portion.

12. The liquified gas dry-cleaning system of claim 11 in which said basket has a conical front portion which defines said entry opening, and said lint filter is disposed below said conical front portion of said basket.

13. The liquified gas dry-cleaning system of claim 12 in which said lint filter has a wedge-shaped housing mounted below said conical front portion of said basket.

14. The liquified gas dry-cleaning system of claim 12 in which said lint filter has a housing mounted in a space between said conical basket front portion and an internal cylindrical wall of said cleaning vessel chamber.

15. The liquified gas dry-cleaning system of claim 12 in which said cleaning vessel chamber is cylindrical in shape, and said lint filter has a housing with a bottom cylindrical wall similar in shape to an internal cylindrical wall of said cleaning vessel chamber and a conically configured upper wall similar in shape to the conical front portion of said basket.

16. The liquified gas dry-cleaning system of claim 15 in which said bottom wall has a discharge opening communicating with said drain.

17. The liquified gas dry-cleaning system of claim 15 in which said in which said upper wall is disposed in spaced relation to said basket front conical portion and said filter surface is disposed in rearwardly spaced relation to an inner face of said door when in a closed position for enabling circulation of the wash bath about the lint filter housing and the free flow of wash bath through the filter surface.

18. The liquified gas dry-cleaning system of claim 9 in which said basket is cylindrical, and said filter surface is oriented in a plane perpendicular to the axis of said cylindrical basket.

19. A liquified gas dry-cleaning system comprising:

a cleaning vessel having a chamber for containing a wash bath of liquified gas under pressure; a basket supported within said chamber for containing items during cleaning, said basket having a perforated cylindrical portion and a front portion that defines a front entry opening of smaller diameter than said cylindrical portion for enabling items to be introduced and removed from said basket, said cleaning vessel having door that is movable between an open position for enabling items to be loaded into said basket and a closed position sealing said cleaning vessel chamber, a liquid gas supply operable for selectively directing liquified gas to said cleaning chamber when said door is in a closed position for use during a cleaning operation cycle, said cleaning vessel having a drain for draining the wash bath from the cleaning vessel following a cleaning operation, a lint filter mounted within said pressure vessel at a location between said basket cylindrical portion and front entry opening, said lint filter having a filter surface through which said wash bath passes as it is directed to said drain, and said filter surface being accessible for manual cleaning upon movement of said door to said open position.

20. The liquified gas dry-cleaning system of claim 19 in which said cleaning vessel chamber has a cylindrical side wall, and said lint filter is mounted on said cleaning vessel chamber cylindrical side wall at a location below said front basket portion and forwardly of said cylindrical portion.

* * * * *